US010381764B2

(12) United States Patent
Horiuchi

(10) Patent No.: US 10,381,764 B2
(45) Date of Patent: Aug. 13, 2019

(54) TERMINAL

(71) Applicant: Sumitomo Wiring Systems, Ltd., Yokkaichi, Mie (JP)

(72) Inventor: Kanji Horiuchi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/097,690

(22) PCT Filed: Apr. 21, 2017

(86) PCT No.: PCT/JP2017/015995

§ 371 (c)(1),
(2) Date: Oct. 30, 2018

(87) PCT Pub. No.: WO2017/195569

PCT Pub. Date: Nov. 16, 2017

(65) Prior Publication Data

US 2019/0157786 A1 May 23, 2019

(30) Foreign Application Priority Data

May 12, 2016 (JP) ..... 2016-095878

(51) Int. Cl.
*H01R 13/11* (2006.01)
*H01R 13/187* (2006.01)

(52) U.S. Cl.
CPC ..... *H01R 13/11* (2013.01); *H01R 13/113* (2013.01); *H01R 13/187* (2013.01)

(58) Field of Classification Search
CPC .... H01R 13/11; H01R 13/113; H01R 13/187; H01R 13/4223

(Continued)

(56) References Cited

U.S. PATENT DOCUMENTS 6,116,970 A * 9/2000 Yamamoto ..... H01R 13/113 439/852
6,478,636 B1 * 11/2002 Makita ..... H01R 13/113 439/852

(Continued)

FOREIGN PATENT DOCUMENTS

JP 10-247539 9/1998
JP 2002-63961 2/2002

(Continued)

OTHER PUBLICATIONS

International Search Report dated Jul. 11, 2017.

*Primary Examiner* — Edwin A. Leon
*Assistant Examiner* — Oscar C Jimenez
(74) *Attorney, Agent, or Firm* — Gerald E. Hespos; Michael J. Porco; Matthew T. Hespos

(57) ABSTRACT

A terminal (10) includes a body (21), a resilient contact piece (30) displaceable in a direction to separate a first contact point (31) from a second wall (bottom wall 22), and three projections (40F, 40R) provided to project toward a first wall (ceiling wall 25) from the second wall. The front projection (40F) disposed in front of the first contact point includes a front contact point (41F) provided on a projecting end part thereof and a front bead (42F) having a slope approaching the second wall as the slope extends rearward from the front contact point (41F). The rear projecting portion (40R) disposed behind the first contact point includes a rear contact point (40R) on a projecting end part thereof and a rear bead (42R) having a slope approaching the second wall as the slope extends forward from the rear contact point (41R).

4 Claims, 7 Drawing Sheets

(58) Field of Classification Search
USPC ..... 439/851, 852, 889
See application file for complete search history.

(56) References Cited

U.S. PATENT DOCUMENTS

| | | | | |
|---|---|---|---|---|
| 9,537,227 | B1 * | 1/2017 | Morello | H01R 43/16 |
| 2001/0051472 | A1 | 12/2001 | Sato et al. | |
| 2017/0302018 | A1 * | 10/2017 | Sasaki | H01R 13/113 |
| 2017/0310032 | A1 * | 10/2017 | Sasaki | H01R 13/113 |
| 2018/0090854 | A1 * | 3/2018 | Lewis | H01R 4/26 |
| 2019/0036259 | A1 * | 1/2019 | Amano | H01R 13/113 |

FOREIGN PATENT DOCUMENTS

| | | |
|---|---|---|
| JP | 2011/125727 | 10/2011 |
| JP | 2014-93197 | 5/2014 |
| JP | 2015-204186 | 11/2015 |

* cited by examiner

TERMINAL

BACKGROUND

Field of the Invention

This specification relates to a terminal.

Related Art

Japanese Unexamined Patent Publication No. 2015-204186 discloses a terminal including a box into which a mating terminal is to be inserted. A resilient deflecting portion is arranged inside the box and a facing contact is arranged on a facing side of the resilient deflecting portion. The resilient deflecting portion is provided with an indent projecting toward the facing contact. A forward projection is provided upstream of the indent in an inserting direction of a tab of the mating terminal on the resilient deflecting portion side of the facing contact, and a rearward projection is provided downstream of the indent. A recess is formed on a surface of the facing contact on the resilient deflecting portion side between the forward projection and the rearward projection. The forward projection and the rearward projection disposed on both front and rear sides of the recess serve as contact points capable of coming into line contact with the mating terminal. According to this terminal, when the mating terminal receives a pressing force from the resilient deflecting portion during the insertion thereof, a tip of the mating terminal is inserted along a curved surface of the recess while escaping to a space on the recess side, thereby reducing an operation force in an inserting process.

In the above terminal, it is ideally thought that the shaking of the mating terminal can be eliminated by each of the forward projection and the rearward projection coming into line contact with the mating terminal. However, since heights of the forward projection and the rearward projection actually vary to a certain extent, the respective projections and the mating terminal come into point contact. In addition, contact point positions and the number of contact points are not fixed. Thus, it may not be possible to eliminate the shaking of the mating terminal depending on the contact point positions and the number of the contact points.

SUMMARY

A terminal disclosed by this specification includes a body having a rectangular tube shape. The body includes a first wall and a second wall disposed to face the first wall. A resilient contact piece extends in the body from a front or rear edge of the first wall. The resilient contact piece includes a first contact point that projects toward the second wall. The resilient contact piece is displaceable in a direction to separate the first contact point from the second wall, and three projections project from the second wall toward the first wall. The three projections include front and rear projections. The front projection includes a front contact point disposed in front of the first contact point and a front bead having a slope approaching the second wall as the slope extends rearward from the front contact point. The rear projection includes a rear contact point disposed behind the first contact point and a rear bead having a slope approaching the second wall as the slope extends forward from the rear contact point.

In this way, when being fit into the body, a mating terminal is sandwiched between the resilient contact piece on the first wall and the three projections on the second wall.

At this time, the mating terminal is held in contact with the three projections by a force receiving from the resilient contact piece, contact point positions and the number of the contact points are fixed.

Further, when the mating terminal is inserted into the body, a tip of the mating terminal is guided rearward by the front and rear beads. Therefore there is no possibility that an operation force increases due to the butting of the tip of the mating terminal against the rear contact point.

The front and rear projections may extend in a front-rear direction, and a rear end of the front bead may be located behind a front end of the rear bead. According to this configuration, the tip of the mating terminal is transferred from the front bead to the rear bead. Thus, the mating terminal can be inserted smoothly.

Two front projections may be provided and one rear projection may be provided. According to this configuration, the mating terminal is supported by the two front beads immediately after the mating terminal is inserted into the body. Thus, the shaking of the mating terminal can be eliminated from an early stage of insertion.

According to the terminal disclosed by this specification, the contact point positions with the mating terminal and the number of the contact points can be fixed and an increase of an operation force due to the butting of the tip of the mating terminal against the rear contact point can be avoided.

DETAILED DESCRIPTION

Figure 1:
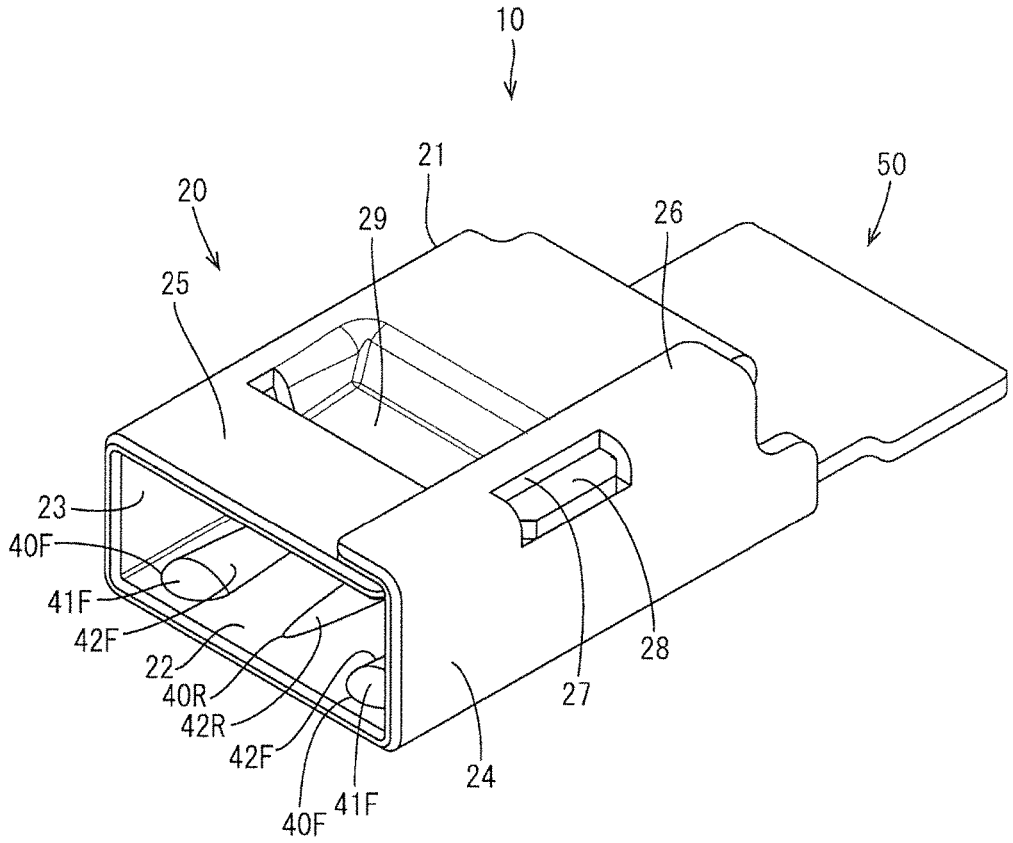
FIG. 1 is a perspective view of a terminal.
Figure 2:
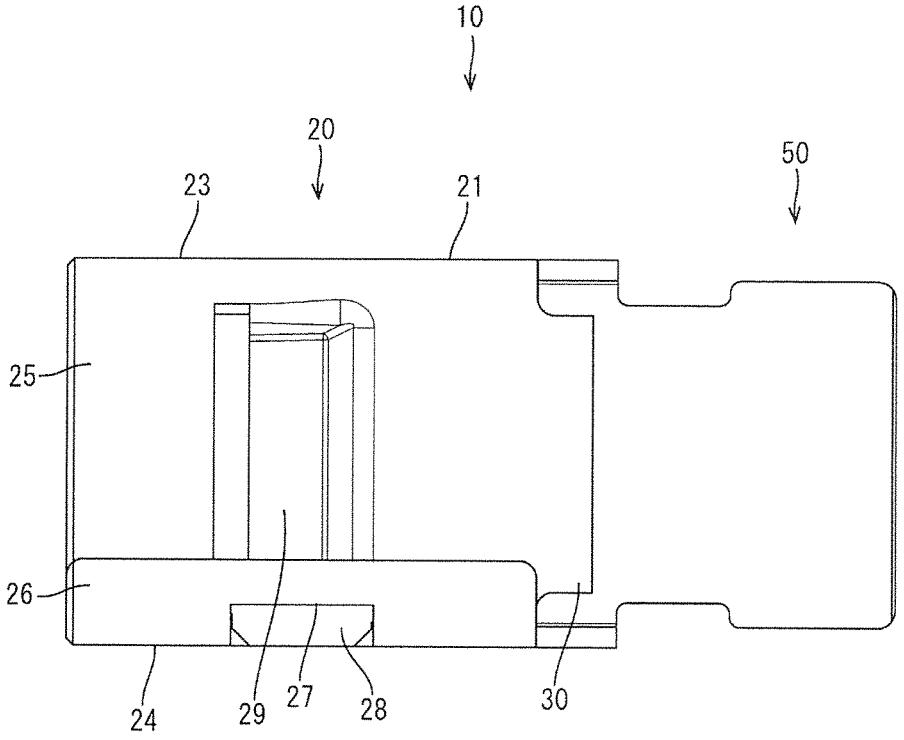
FIG. 2 is a plan view of the terminal.
Figure 3:
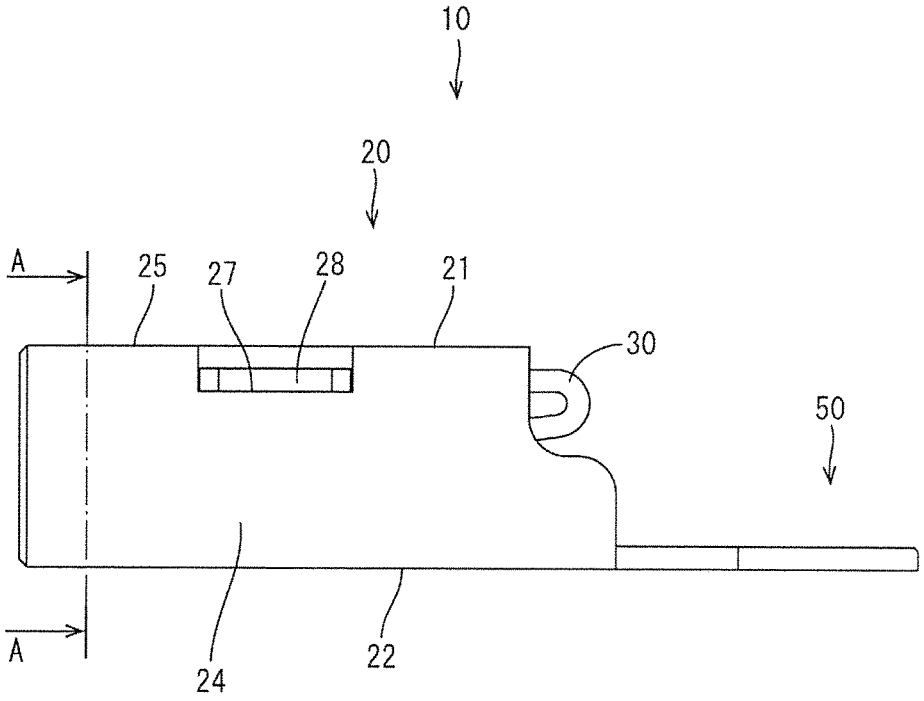
FIG. 3 is a side view of the terminal.

An embodiment is described with reference to FIGS. 1 to 9. A terminal 10 of this embodiment includes, as shown in FIG. 1, a terminal connecting portion 20 to be connected to a mating terminal 60 and a wire connecting portion 50 connected behind the terminal connecting portion 20. The terminal 10 is a female terminal and the mating terminal 60, which is a male terminal in the form of a flat tab, is connectable to the terminal connecting portion 20. In the following description, a connecting direction of the terminal 10 and the mating terminal 60 is referred to as a front-rear direction, a side to be connected to the mating terminal 60 is referred to as a front side, and a vertical direction and a lateral direction are based on FIG. 5.

The wire connecting portion 50 is a flat plate, and a core of an unillustrated wire can be welded to the upper surface of the wire connecting portion 50 by welding, such as resistance welding. Although the core of the wire is connected to the wire connecting portion 50 by welding in this embodiment, the core of the wire may be connected to a wire connecting portion by crimping.

The terminal connecting portion 20 includes a body 21 having a rectangular tube shape. The body 21 includes a bottom wall 22, a left side wall 23 rising up from the left side of the bottom wall 22, a right side wall 24 rising up from the right side of the bottom wall 22, a ceiling wall 25 extending right from the upper end of the left side wall 23 and an opening preventing wall 26 extending left along the upper surface of the ceiling wall 25 from the upper end of the right side wall 24. In other words, the left side wall 23 couples the left side of the bottom wall 22 and that of the ceiling wall 25, and the right side wall 24 couples the right side of the bottom wall 22 and that of the ceiling wall 25.

The opening preventing wall 26 prevents the upward opening of the ceiling wall 25 by pressing a right end part of the ceiling wall 25 from above. Further, a locking hole 27 is open at a corner part between the opening preventing wall 26 and the right side wall 24. A locking piece 28 provided on the right end part of the ceiling wall 25 is fit into this locking hole 27. The locking piece 28 is locked to an edge of the locking hole 27 to prevent movement of the ceiling wall 25 in the front-rear direction.

Figure 5:
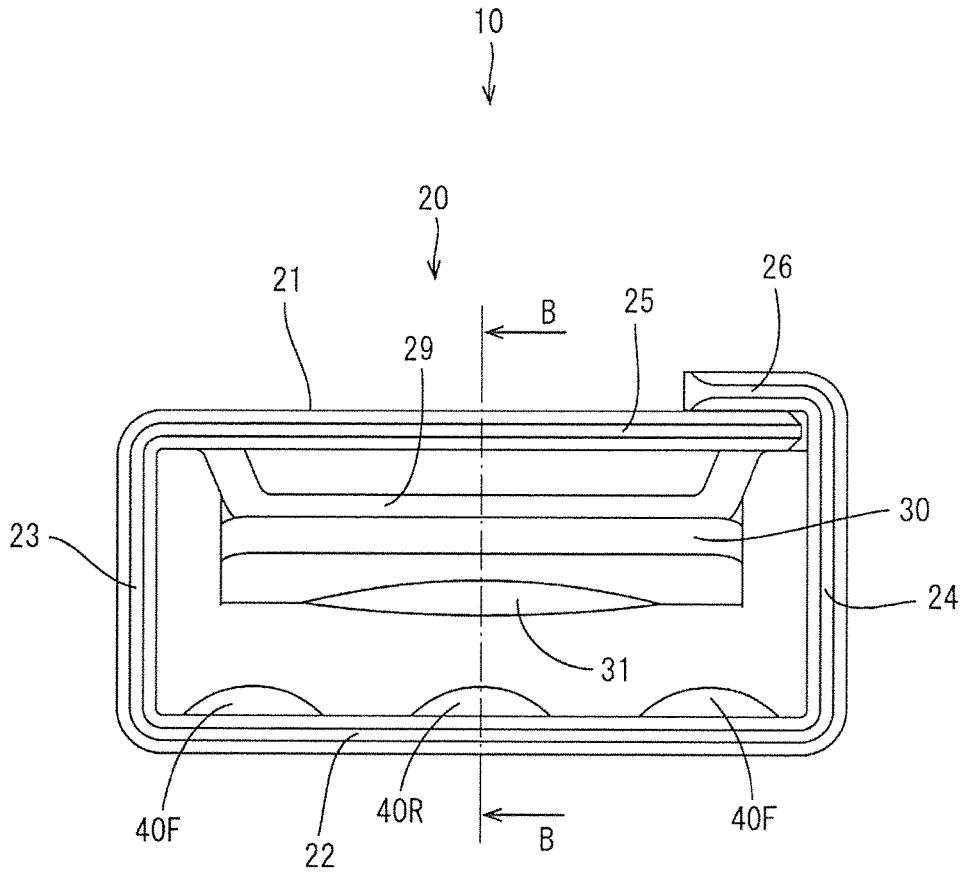
FIG. 5 is a front view of the terminal.

As shown in FIG. 5, the ceiling wall 25 is located above the bottom wall 22, and the ceiling wall 25 and the bottom wall 22 are disposed in parallel to face each other. A part of the ceiling wall 25 projects down, and this projecting part serves as an excessive deflection preventing portion 29. The excessive deflection preventing portion 29 functions to prevent a resilient contact piece 30 to be described next from being excessively deflected toward the ceiling wall 25 and plastically deformed.

Figure 6:
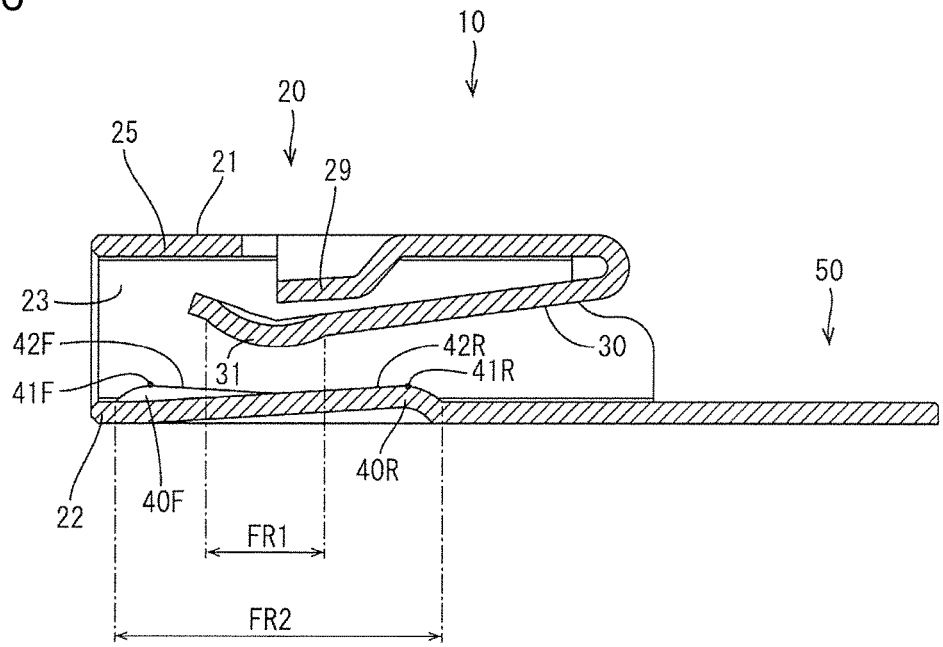
FIG. 6 is a section along B-B in FIG. 5.

As shown in FIG. 6, the resilient contact piece 30 is folded inwardly of the body portion 21 from the rear edge of the ceiling wall 25 and extends forward. The resilient contact piece 30 has a chevron shape, and a first contact point 31 projects down on a lower end part of the resilient contact piece 30. The first contact point 31 is located near the front end of the resilient contact piece 30 and somewhat in front of the aforementioned excessive deflection preventing portion 29. The resilient contact piece 30 is displaceable in a direction to separate the first contact point 31 from the bottom wall 22 by the first contact point 31 riding on the upper surface of the mating terminal 60 when the mating terminal 60 is inserted into the body 21.

As shown in FIG. 5, both the resilient contact piece 30 and the excessive deflection preventing portion 29 are formed over substantially the entire width of the ceiling wall 25. Thus, the resilient contact piece 30 comes into contact with the excessive deflection preventing portion 29 over the entire width. This can prevent the resilient contact piece 30 from being pressed upward and plastically deformed, for example, when the mating terminal 60 is inserted obliquely into the body 21. The upper surface of the resilient contact piece 30 comes into surface contact with the lower surface of the excessive deflection preventing portion 29. Thus, even if a strong force is applied, this force can be distributed in a wide range, thereby preventing excessive deflection of the resilient contact piece 30.

As shown in FIG. 5, three projections project up on the bottom wall 22. The projection located in the middle is a rear projection 40R and the projections located on both left and right sides are front projections 40F. As shown in FIG. 6, the front projection 40F includes a front contact point 41F disposed in front of the first contact point 31 and a front bead 42F having a slope approaching the bottom wall 22 as it extends rearward from the front contact point 41F. The rear projection 40R includes a rear contact point 41R disposed behind the first contact point 31 and a rear bead 42R having a slope approaching the bottom wall 22 as it extends forward from the rear contact point 41R. The front projection 40F on the left side is disposed near the left side wall 23, and the front projection 40F on the right side is disposed near the right side wall 24. Thus, a sufficient separation distance is secured between left and right front contact points 41F located on the front side and the first contact point 31, thereby increasing a rotational moment necessary to rotate the mating terminal 60 about the first contact point 31 even if only slightly.

Figure 4:
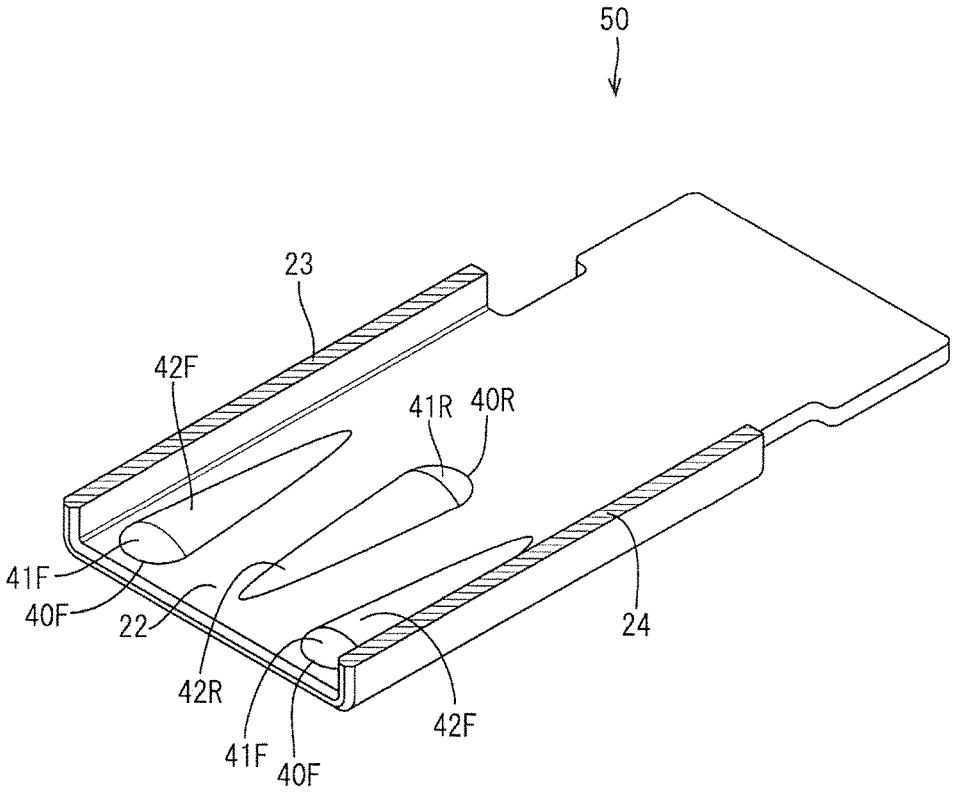
FIG. 4 is a perspective view of the terminal with parts of FIG. 1 cut away.

As shown in FIG. 4, the front contact point 41F has a front hemispherical shape. Similarly, the rear contact point 41R has a rear hemispherical shape.

Both the front beads 42F and the rear bead 42R extend in the front-rear direction and are arranged independently side by side in parallel to each other, and the rear ends of the front beads 42F are located behind the front end of the rear bead 42R. More specifically, the rear ends of the front beads 42F are at the same position as the rear contact point 41R in the front-rear direction, and the front end of the rear bead 42R is at the same position as the front contact points 41F in the front-rear direction.

As shown in FIG. 6, the front beads 42F and the rear bead 42R intersect in a side view. When the tip of the mating terminal 60 is guided rearward along the front beads 42F, the tip of the mating terminal 60 is transferred to the rear bead 42R above the bottom wall 22 and is guided rearward along the rear bead 42R. Thus, the mating terminal 60 can be inserted smoothly. Therefore, there is no possibility that the tip of the mating terminal 60 drops to the bottom wall 22 and butts against the rear contact point 41R to increase an insertion force.

Figure 7:
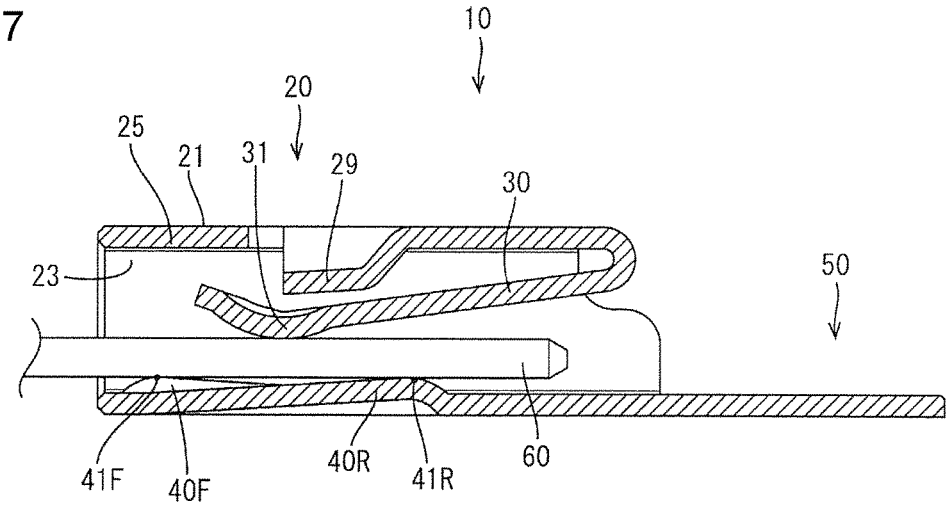
FIG. 7 is a section showing a state where a mating terminal is inserted into a body portion from a state of FIG. 6.

As shown in FIG. 6, an area FR1 occupied by the first contact point 31 in the front-rear direction is located within a range of an area FR2 from the front ends of the front projections 40F to the rear end of the rear projection 40R. This means that the mating terminal 60 is supported on the contact points 41F, 41R at two front and rear positions if the first contact point 31 rides on the upper surface of the mating terminal 60 to press the mating terminal 60 down when the mating terminal 60 is inserted into the body 21, as shown in FIG. 7. By doing so, even if the mating terminal 60 is going to be oriented so that the front end thereof is inclined up or down, the mating terminal 60 is corrected to have an initial horizontal posture. Therefore the shaking of the mating terminal 60 can be eliminated.

Figure 8:
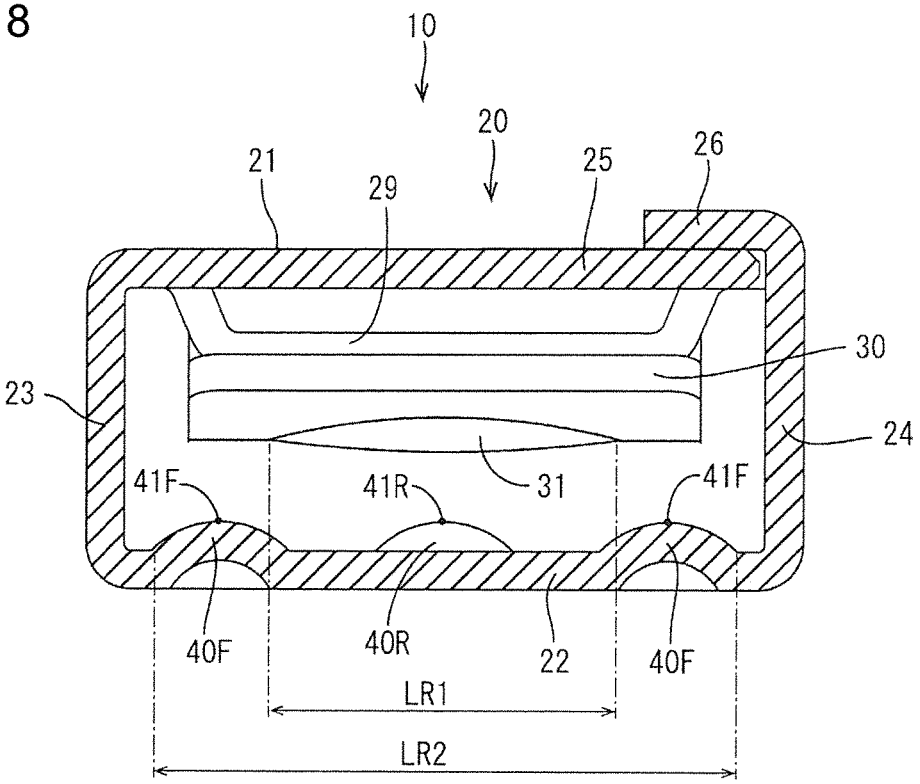
FIG. 8 is a section along A-A in FIG. 3.
Figure 9:
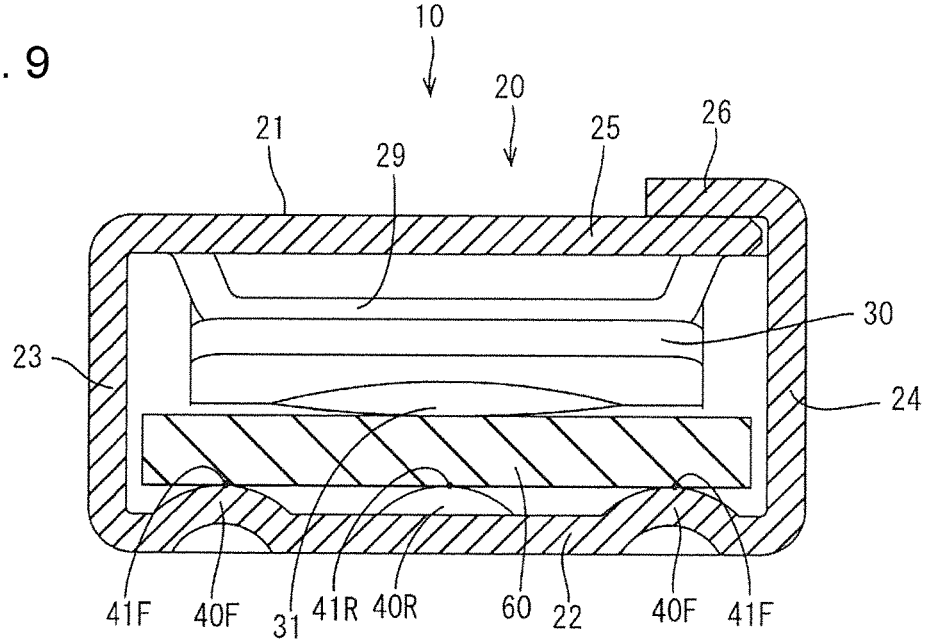
FIG. 9 is a section showing a state where the mating terminal is inserted into the body portion from a state of FIG. 8.

Further, as shown in FIG. 8, an area LR1 occupied by the first contact point 31 in the lateral direction is located within a range of an area LR2 from the left end of the front projection 40F on the left side to the right end of the front projection 40F located on the right side. This means that the mating terminal 60 is supported by the contact points 41F on left and right positions if the first contact point 31 rides on the upper surface of the mating terminal 60 to press the mating terminal 60 down when the mating terminal 60 is inserted into the body 21, as shown in FIG. 9. By doing so, even if the mating terminal 60 is going to be oriented so that the left end thereof is inclined up or down (or the right end thereof is inclined up or down), the mating terminal 60 is corrected to have the initial horizontal posture. Therefore the shaking of the mating terminal 60 can be eliminated.

If this configuration is adopted, when the mating terminal 60 is pressed toward the bottom wall 22 by a force receiving from the first contact point 31, the mating terminal 60 invariably is supported by the three contact points 41F, 41R. Thus, the mating terminal 60 is sandwiched resiliently by the first contact point 31 of the resilient contact piece 30 and the three contact points 41F, 41R on the bottom wall 22 to have three clearly defined contact points.

As described above, when being fit into the body 21, the mating terminal 60 is sandwiched between the resilient contact piece 30 of a first wall (ceiling wall 25) and the three projections 40F, 40R on a second wall (bottom wall 22). At this time, the mating terminal 60 is held in contact with three projections 40F, 40R by the force from the resilient contact piece 31. Therefore the contact points and the number of the contact points are fixed.

Further, the tip of the mating terminal 60 is guided rearward by the front beads 42F and the rear bead 42R when the mating terminal 60 is inserted into the body portion 21. Thus, there is no possibility that an operation force increases due to the butting of the tip of the mating terminal 60 against the rear contact point 41R.

The front beads 42F and the rear beads 42R extend in the front-rear direction, and the rear ends of the front beads 42F are located behind the front end of the rear bead 42R. According to this configuration, the tip of the mating terminal 60 is transferred from the front beads 42F to the rear bead 42R so that the mating terminal 60 can be inserted smoothly.

Two front projections 40F and one rear projection 40R may be provided. According to this configuration, the mating terminal 60 is supported by the two front beads 42F immediately after the mating terminal 60 is inserted into the body portion 21. Thus, the shaking of the mating terminal 60 can be eliminated from an early stage of insertion.

The invention is not limited to the above described and illustrated embodiment. For example, the following modes also are included.

The body 21 in the form of a rectangular tube composed of four walls is illustrated in the above embodiment. However, a body having another form or a body in a rectangular tube composed of wall portions may be used as long as the body includes a first wall and a second wall.

Although two front contact points 41F and one rear contact point 41R are disposed on the bottom wall 22 in the above embodiment, one front contact point and two rear contact points may be disposed on the bottom wall 22.

The resilient contact piece 30 is provided by being folded inwardly of the body 21 from the rear of the ceiling wall 25 in the above embodiment. However, a resilient contact piece folded inwardly of the body 21 from the front of the ceiling wall 25 may be provided or a resilient contact piece may be provided on the side of the bottom wall 22.

Although the respective beads 42F, 42R are provided independently in the above embodiment, the front beads 42F and the rear bead 42R may be provided integrally, for example, by coupling the front contact points 41F and the rear contact point 41R.

LIST OF REFERENCE SIGNS

10 . . . terminal
21 . . . body
22 . . . bottom wall (second wall)
23 . . . left side wall (third wall)
24 . . . right side wall (fourth wall)
25 . . . ceiling wall (first wall)
30 . . . resilient contact piece
31 . . . first contact point
40F . . . front projecting portion
40R . . . rear projecting portion
41F . . . front contact point
41R . . . rear contact point
42F . . . front bead
42R . . . rear bead
60 . . . mating terminal

The invention claimed is:

1. A terminal, comprising:

a body having a rectangular tube shape, the body including a first wall and a second wall disposed to face the first wall;

a resilient contact piece extending in the body from a front or rear end of the first wall, the resilient contact piece including a first contact point projecting toward the second wall, the resilient contact piece being displaceable in a direction to separate the first contact point from the second wall; and three projections projecting from the second wall toward the first wall, the three projections including front and rear projections;

the front projection including a front contact disposed in front of the first contact point and a front bead having a slope approaching the second wall as the slope extends rearward from the front contact point; and the rear projection including a rear contact disposed behind the first contact point and a rear bead having a slope approaching the second wall as the slope extends forward from the rear contact point.

2. The terminal of claim 1, wherein the both front and rear projections extend in a front-rear direction, and a rear end of the front bead is located behind a front end of the rear bead.

3. The terminal of claim 2, wherein two front projecting portions are provided and one rear projecting portion is provided.

4. The terminal of claim 1, wherein two front projecting portions are provided and one rear projecting portion is provided.

* * * * *